US007400336B2

(12) United States Patent
Min

(10) Patent No.: US 7,400,336 B2
(45) Date of Patent: Jul. 15, 2008

(54) THERMAL PRINTER

(75) Inventor: Byung-sun Min, Pyeongtaek-si (KR)

(73) Assignee: Samsung Electronics Co., Ltd., Yeongtong-Gu, Suwon-Si, Gyeongg-Do (KR)

( * ) Notice: Subject to any disclaimer, the term of this patent is extended or adjusted under 35 U.S.C. 154(b) by 322 days.

(21) Appl. No.: 11/218,437

(22) Filed: Sep. 6, 2005

(65) Prior Publication Data

US 2006/0092260 A1 May 4, 2006

(30) Foreign Application Priority Data

Oct. 28, 2004 (KR) ..... 10-2004-0086545

(51) Int. Cl.
*B41J 2/335* (2006.01)

(52) U.S. Cl. ..... 347/209

(58) Field of Classification Search ..... 347/209, 347/220, 197, 171, 104; 400/120.17
See application file for complete search history.

(56) References Cited

U.S. PATENT DOCUMENTS

| | | | |
|---|---|---|---|
| 4,987,442 | A | 1/1991 | Uemori |
| 2002/0001027 | A1 | 1/2002 | Sugioka et al. |
| 2003/0112315 | A1 | 6/2003 | Hetzer |
| 2005/0078996 | A1 | 4/2005 | Lee |

FOREIGN PATENT DOCUMENTS

| | | |
|---|---|---|
| FR | 856-982 | 8/1940 |
| JP | 56-004480 | 7/1981 |
| JP | 63-091261 | 4/1988 |
| JP | 04-105956 | 4/1992 |
| JP | 05-016408 | 1/1993 |
| JP | 05-065633 | 3/1993 |
| JP | 05-069633 | 3/1993 |
| JP | 05-238073 | 9/1993 |
| JP | 05-309857 | 11/1993 |
| JP | 2000-334992 | 12/2000 |
| JP | 2001-260515 | 9/2001 |

*Primary Examiner*—K. Feggins
(74) *Attorney, Agent, or Firm*—Roylance, Abrams, Berdo & Goodman, LLP

(57) ABSTRACT

A thermal printer includes an improved cable for connecting a main board and a recording head and that forms an image on a print medium by heating both surfaces of the print medium. The thermal printer includes a rotating unit rotatably installed within a frame and having a recording head and a support member. A main board is installed on the frame and supplies power to and provides image data to the recording head. A flexible cable is disposed on one side or both sides of the print medium to connect the main board and the recording head. The recording head forms an image on a print medium by heating a surface or an opposite surface of the print medium according to a location to which the recording head is rotated. The support member is installed opposite to the recording head and supports the print medium. The flexible cable is disposed to not interfere with a transfer of the print medium and a reciprocating rotation of the recording head.

16 Claims, 6 Drawing Sheets

THERMAL PRINTER

BACKGROUND OF THE INVENTION

This application claims the benefit under 35 U.S.C. § 119 (a) of Korean Patent Application No. 10-2004-0086545, filed on 28 Oct. 2004, in the Korean Intellectual Property Office, the entire disclosure of which is hereby incorporated by reference.

FIELD OF THE INVENTION

The present invention relates to a thermal printer. More particularly, the present invention relates to a thermal printer that includes an improved cable for connecting a main board and a recording head and that forms an image on a print medium by heating both surfaces of the print medium.

DESCRIPTION OF THE RELATED ART

Conventional thermal printers print an image on a thermal imaging print medium by applying heat from a recording head to the print medium. The print medium provides a color image of a color selected according to a heating temperature and a heating duration. The print medium is different than paper, which is typically used as a print medium, and has a structure as illustrated in FIG. 1.

Referring to FIG. 1, the print medium includes a transparent substrate 1. A first image forming layer 2, a spacer 3, a second image forming layer 4, and an upper protection layer 5 are sequentially stacked on an upper surface of the transparent substrate 1. A third image forming layer 6, a reflection layer 7, and a lower protection layer 8 are sequentially stacked on a lower surface of the transparent substrate 1.

The first, second, and third image forming layers 2, 4, and 6, which produce different colors, are formed of yellow, magenta, and cyan leuco dyes, respectively, and a developer. The spacer 3 separates the first image forming layer 2 from the second image forming layer 4 and is transparent so that colors produced in the first and second forming layers 2 and 4 are recognized when viewed from the side of the upper protection layer 5 opposite to the second forming layer 4. The first, second, and third image forming layers 2, 4, and 6 represent colors that respond to different heating temperatures and heating durations.

To form an image on a print medium having such a structure, a conventional thermal printer has a structure as illustrated in FIG. 2.

Referring to FIG. 2, the conventional thermal printer includes a transfer unit 10 for transferring a print medium M. First and second recording heads 21 and 25 are disposed on both surfaces of the print medium M, respectively. First and second support units 31 and 35 are disposed to face the first and second recording heads 21 and 25, respectively. The first and second recording heads 21 and 25 are electrically connected to a main board 40 to receive power and image data from the main board 40.

As described above, in the conventional thermal printer that forms a color image on the print medium M using the two recording heads 21 and 25, the recording heads 21 and 25 are easily connected to the main board 40 using cables 41 and connectors 45. However, the use of the two recording heads 21 and 25 complicates the structure of the thermal printer and increases the costs of manufacturing the thermal printer.

Thus, a need exists for a thermal printer for forming an image on both surfaces of a print medium by using a single recording medium that is movable. Because a main board is fixed and the recording head is movable, a structure of a cable connecting the main board to the recording head must be improved to not effect the transfer of a print medium while maintaining the compact size of the thermal printer.

Accordingly, a need exists for a thermal printer having an improved cable to connect a movable recording head to a main board.

SUMMARY OF THE INVENTION

The present invention provides a thermal printer having a cable connecting a movable recording head to a main board that does not interfere with the transfer of a print medium in the thermal printer and maintains the compact size of the thermal printer.

According to an aspect of the present invention, a thermal printer includes a rotating unit rotatably installed within a frame and having a recording head and a support member. A main board is installed on the frame and supplies power to and provides image data to the recording head. A flexible cable is disposed on one side or both sides of the print medium to connect the main board and the recording head. The recording head forms an image on a print medium by heating a surface or an opposite surface of the print medium according to a location to which the recording head is rotated. The support member is installed opposite to the recording head and supports the print medium. The flexible cable is disposed to not interfere with a transfer of the print medium and a reciprocating rotation of the recording head.

According to another aspect of the present invention, a thermal printer includes a recording head rotatably installed within a frame to form an image on a print medium by heating a surface or an opposite surface of the print medium according to a location to which the recording head is rotated. A platen roller is installed opposite to the recording head to form a nip by supporting the print medium. A support bracket supports the recording head so that the recording head rotates about a rotating shaft of the platen roller. A driving source provides a rotating force to the support bracket. A main board is installed on the frame to supply power to and to provide image data to the recording head. A flexible cable is disposed on one side or both sides of the print medium to connect the main board to the recording head. The flexible cable is shaped and disposed to not interfere with a transfer of the print medium and a reciprocating rotation of the recording head.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

A thermal printer according to an exemplary embodiment of the present invention forms an image on a thermal imaging print medium by heating both surfaces of the print medium using a single recording head. The thermal printer according to an exemplary embodiment of the present invention has a structure illustrated in FIGS. 3 through 5.

Figure 3:
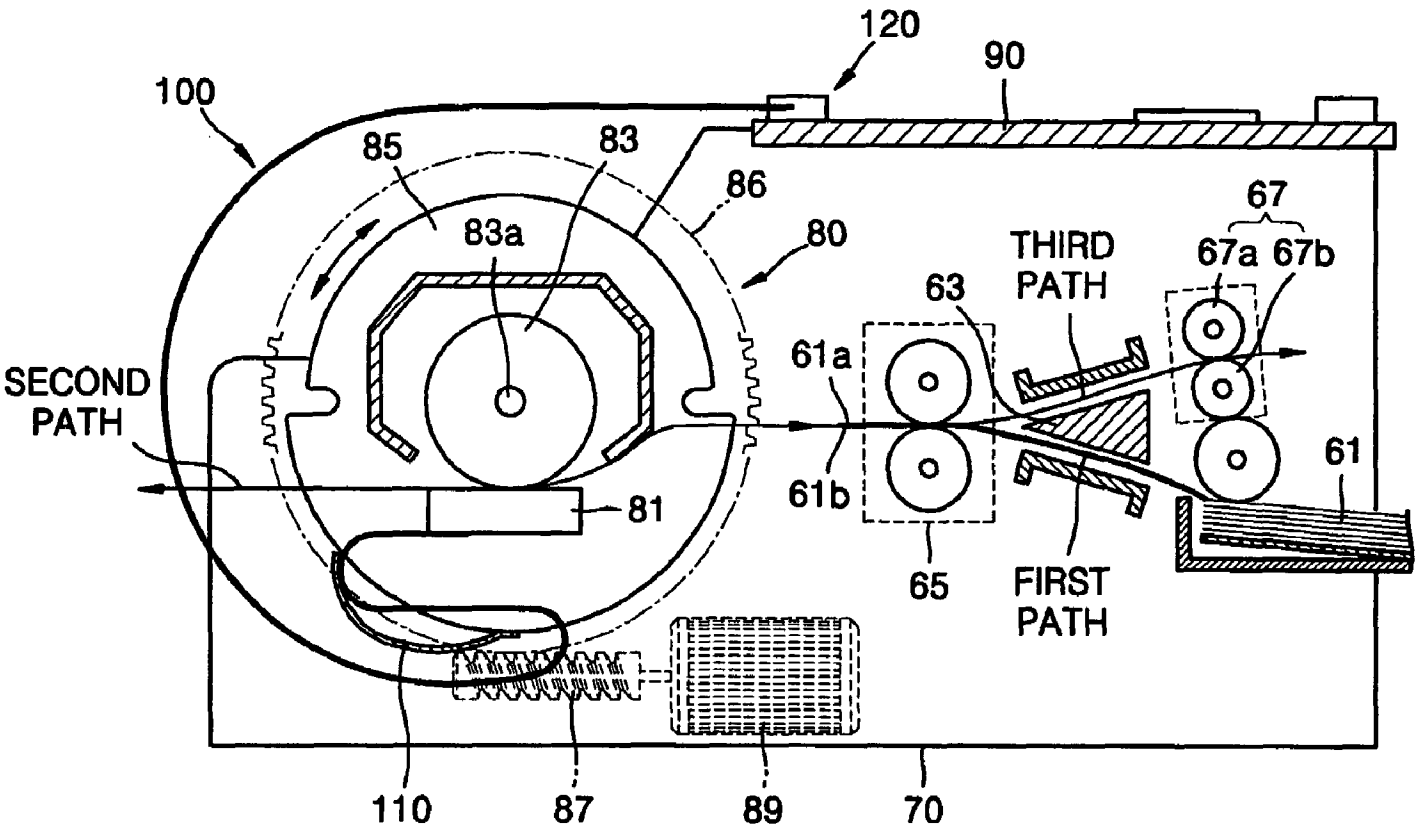
FIGS. 3 and 4 are schematic cross-sections of a thermal printer according to an exemplary embodiment of the present invention.
Figure 4:
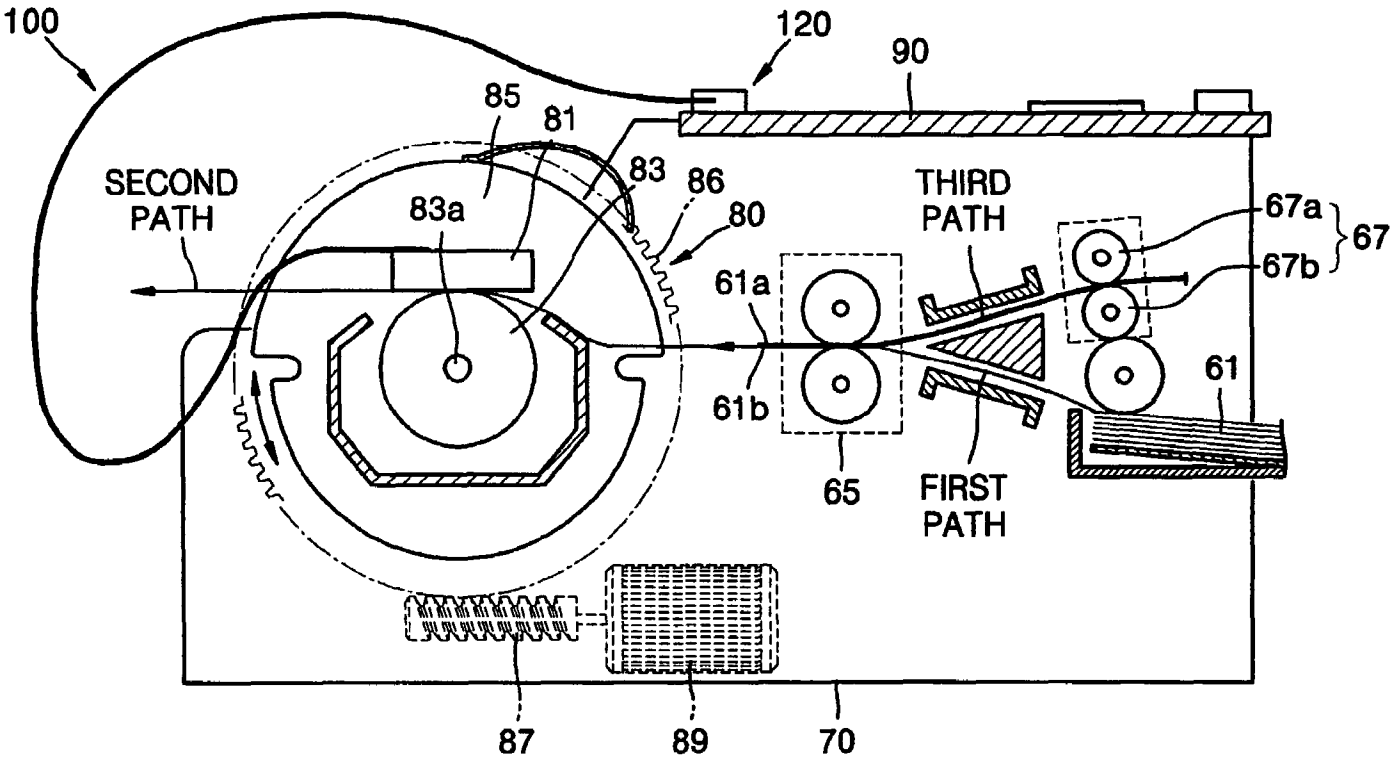
Figure 5:
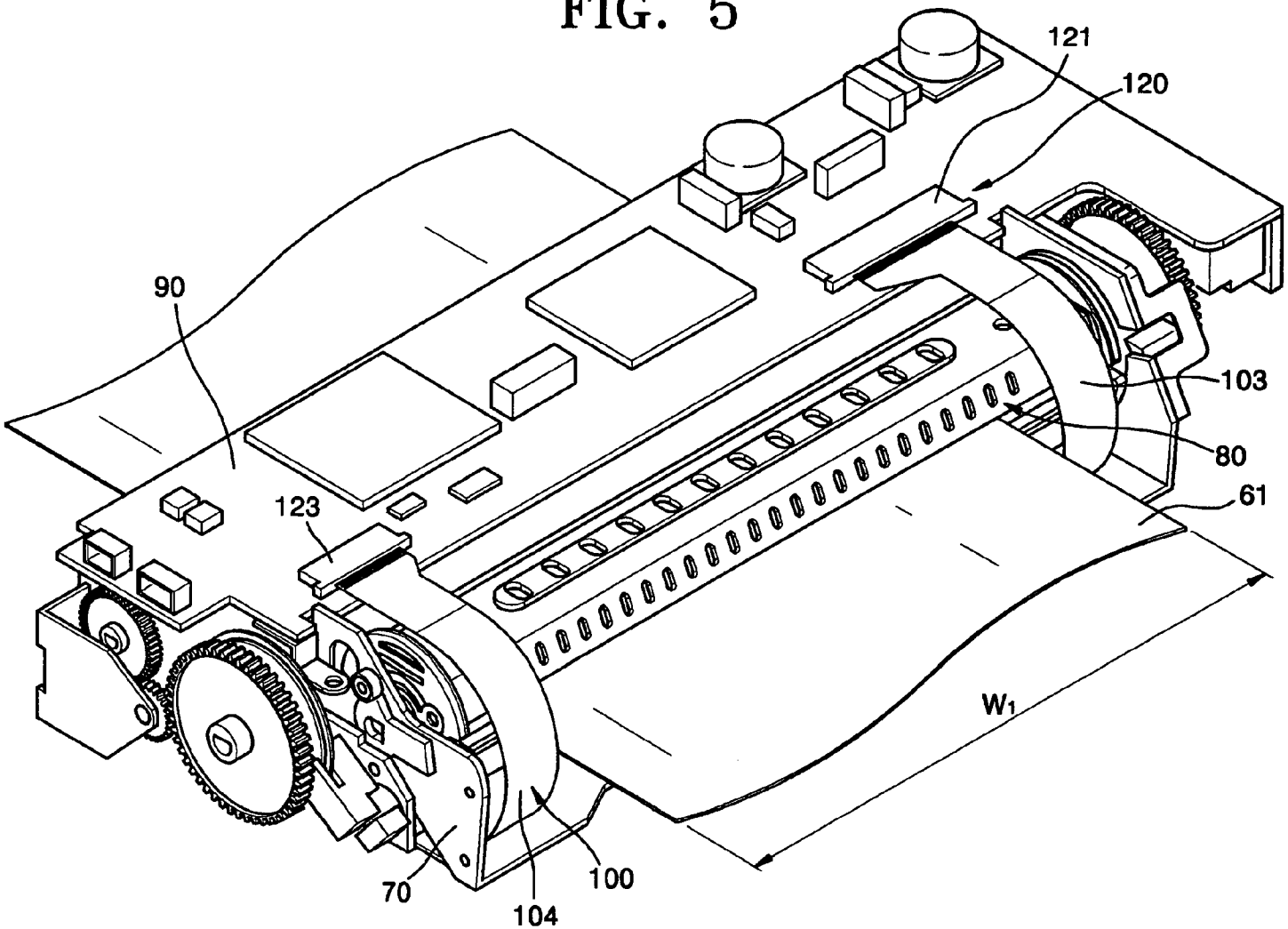
FIG. 5 is a perspective view of the thermal printer of FIGS. 3 and 4.

Referring to FIGS. 3 through 5, the thermal printer includes a rotating unit 80, a main board 90, and a flexible cable 100. The rotating unit 80 is rotatably installed within a frame 70. The main board 90 is installed on the frame 70, and the flexible cable 100 connects the rotating unit 80 and the frame 70.

Figure 1:
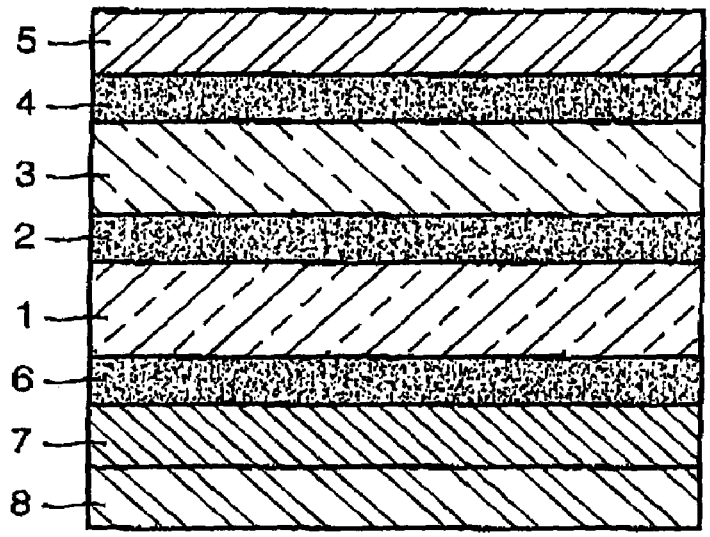
FIG. 1 (PRIOR ART)
FIG. 1 is a schematic cross-section of a conventional thermal imaging print medium.
Figure 2:
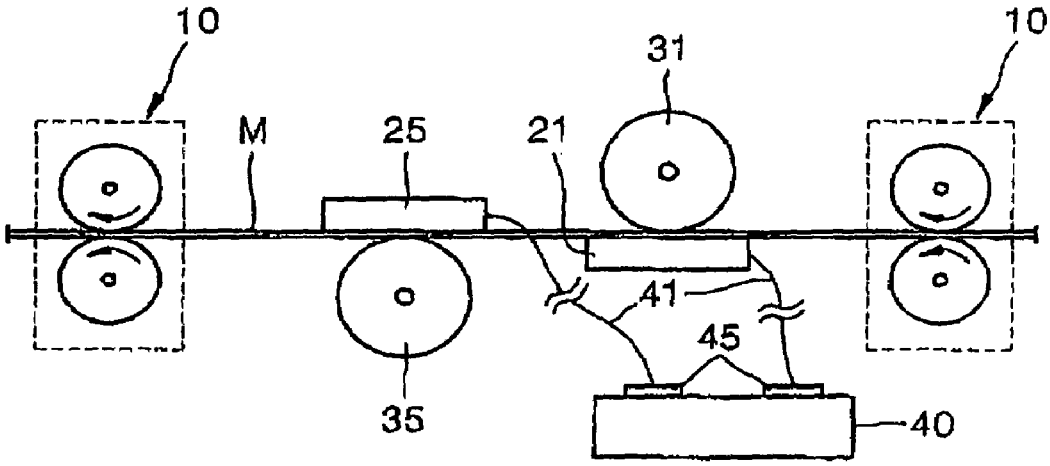
FIG. 2 (PRIOR ART)
FIG. 2 is a schematic cross-section of a conventional thermal printer.

A print medium having such a structure as illustrated in FIG. 1 may be used as a print medium 61. An image is formed on the print medium 61 by heating first and second surfaces 61*a* and 61*b* of the print medium 61. The print medium 61 is disposed so that the first and second surfaces 61*a* and 61*b* move forward and backward along first through third paths without being turned upside down while being transferred within the thermal printer. Print medium 61 is not limited to the thermal imaging print medium of FIG. 1, but may be any other type of thermal imaging print media on which double-sided printing is possible.

The first path is a supply path along which the print medium 61 is transferred to the second path. The second path is where the print medium 61 is printed with an image. The third path is a path along which the print medium 61 is discharged. A print medium guide 63, for guiding the print medium 61, and a transfer unit 65 are disposed between the first and third paths. The print medium guide 63 guides the print medium 61 supplied along the first path to the second path. During printing, the print medium guide 63 guides the print medium 61 from the second path to the third path. The transfer unit 65 transfers the print medium 61 from the first path to the second path, from the second path to the third path, or from the third path to the second path according to a stage of printing. A discharge unit 67, including a discharge roller 67*a* and an idle roller 67*b* engaged with the discharge roller 67*a*, is disposed on the third path to discharge the print medium 61.

The rotating unit 80 includes a recording head 81 and a support member 83. The recording head 81 forms an image on the print medium 61 by heating the print medium 61. The support member 83 is installed opposite to the recording head 81 to support the print medium 61 so that the print medium 61 may thermally contact the recording head 81 during image formation.

The recording head 81 is a thermally recordable head, such as, a thermal print head (TPH), and is rotatably installed within the frame 70. The recording head 81 forms an image by heating either the first or second surface 61*a* or 61*b* of the print medium 61 according to a location to which the recording head 81 is rotated. More specifically, when the recording head 81 is located at a position as illustrated in FIG. 3, an image is formed on the second surface 61*b* of the print medium 61. When the recording head 81 is located at a position as illustrated in FIG. 4, an image is formed on the first surface 61*b* of the print medium 61.

The support member 83 may be a platen roller, as illustrated in FIGS. 3 and 4, and forms a nip by supporting the print medium 61.

In this exemplary embodiment, the recording head 81 is rotated about a rotating shaft 83*a* of the support member 83 and faces either the first or second surface 61*a* or 61*b* of the print medium 61 according to a location to which the recording head 81 is rotated. To rotate the recording head 81 about the rotating shaft 83*a* of the support member 83, the rotating unit 80 further includes a support bracket 85 for supporting the recording head 81 and a driving source for rotating the support bracket 85. The driving source includes a gear portion 86, a driving motor 89, and a worm gear 87. The gear portion 86 is installed around an outer circumference of the support bracket 85. The worm gear 87 transmits power of the driving motor 89 to the gear portion 86. The rotating unit 80 is rotated when the print medium 61 is not present in the second path. The rotating unit 80 is rotated before the print medium 61 is supplied from the first path to the second path or when the print medium 61 of which the first surface 61*a* has been printed with an image does not yet return to the second path after being transferred to the third path.

The main board 90 is installed on the frame 70 of the thermal printer. The main board 90 applies power to and provides image data to the recording head 81 via the flexible cable 100.

The flexible cable 100, which connects the main board 90 to the recording head 81, should not interfere with the transfer of the print medium 61 along the second path and a reciprocating rotation of the recording head 81. The flexible cable 100 connects the main board 90 to the recording head 81 along one side or both sides of the print medium 61.

Figure 6:
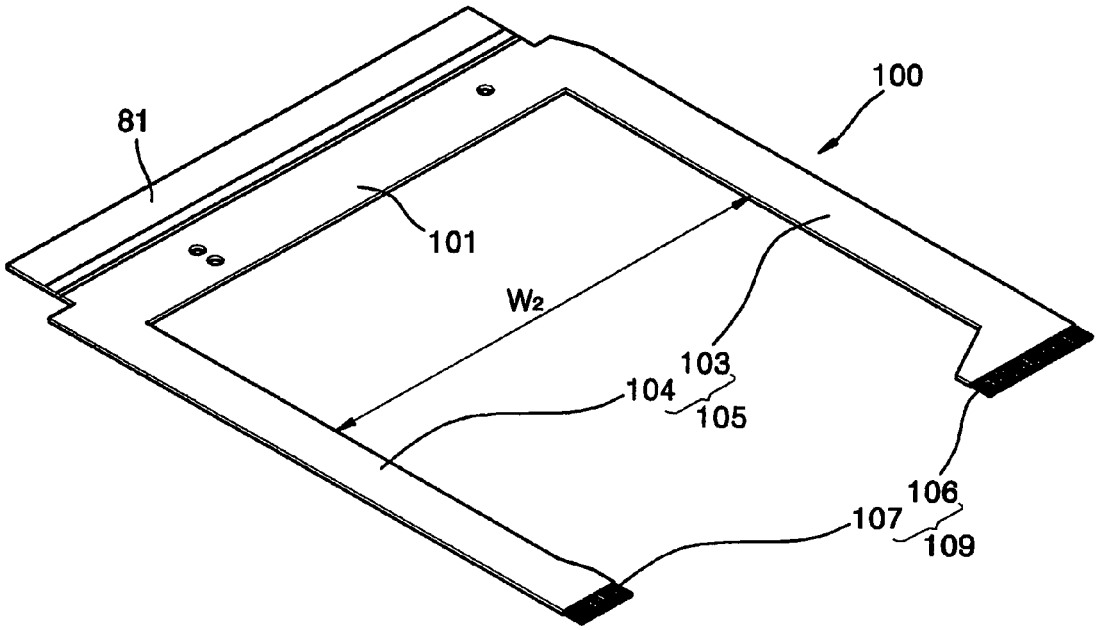
FIG. 6 is a perspective view of a recording head and a flexible cable of FIG. 3.

Referring to FIG. 6, the flexible cable 100 includes a coupling portion 101, which is coupled to the recording head 81, and a cable portion 105 extending from at least one side of the coupling portion 101. The cable portion 105 is connected to the recording head 81, such connection is preferably electrical, optical or both. The coupling portion 101 couples the recording head 81 to the main board 90 and is preferably formed of an elastic material to deform or return to its original shape according to a location to which the recording head 81 is rotated. For example, a flexible printed cable (FPC) having a pattern-shaped wire structure may be used as the flexible cable 100.

Figure 7:
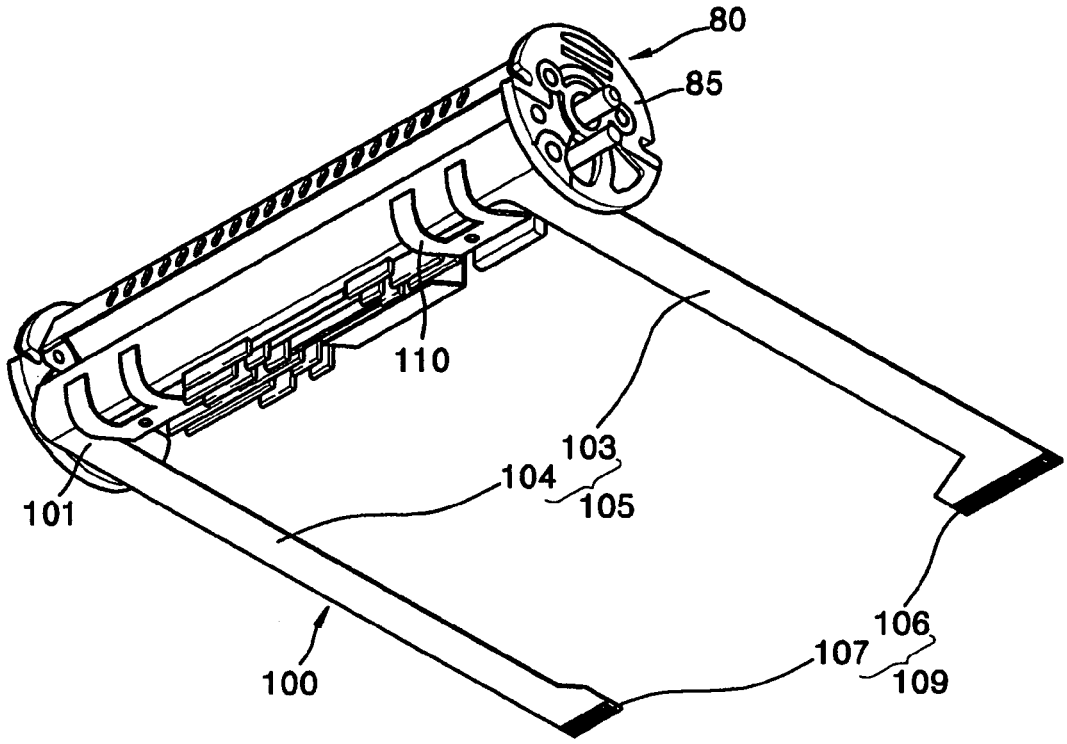
FIG. 7 is a perspective view of a flexible cable fixed onto a rotating unit of FIG. 3 by a fixing holder.

As illustrated in FIGS. 3, 4, and 7, the thermal printer may further include a fixing holder 110 for fixing the coupling portion 101 to the rotating unit 80. The fixing holder 110, which is preferably an elastic plate, is coupled to the rotating unit 80 so that the coupling portion 101 may adhere to an outer circumference of the rotating unit 80. When the coupling portion 101 is fixed to the rotating unit 80 by the fixing holder 110, a rotating radius of the flexible cable 100 is reduced compared to when no fixing holders are included in the structure of FIG. 3. Accordingly, the fixing holders 110 facilitate minimizing the size of the printer.

To connect the cable portion 105 to the main board 90, a connector 109 is formed at an end of the cable portion 105, and a socket 120, which is coupled to the connector 109, is installed on the main board 90. Accordingly, the flexible cable 100 may be detached from the main board 90.

The cable portion 105 has a predetermined length, which is long enough so the cable portion 105 may be connected to the main board 90 and surround the rotating unit 80 when the recording head 81 is located to form an image on the second surface 61*b* of the print medium 61, as shown in FIG. 3.

When the cable portion 105 has such a predetermined length, the cable portion 105 has surplus length when the recording head 81 is located to form an image on the first surface 61*a* of the print medium 61 as shown in FIG. 4. The surplus length of the cable portion 105 gathers on the left and upper sides of the rotating unit 80 due to the elasticity and weight of the cable portion 105.

Referring to FIGS. 5 through 7, the cable portion 105 has a first cable portion 103 extending from one end of the coupling portion 101 and a second cable portion 104 extending from the other end of the coupling portion 101 to supply power and image data. The first cable portion 103 is preferably used to supply power to the main board 90, and the second cable portion 104 is preferably used to transmit image data.

Preferably, a width $W_2$ between the first and second cable portions 103 and 104 is greater than a width $W_1$ of the print medium 61. More preferably, the width $W_2$ between the first and second cable portions 103 and 104 is about 1-30 mm greater than the width $W_1$ of the print medium 61. Due to the use of the first and second cable portions 103 and 104, the print medium 61 may be transferred through a space between the first and second cable portions 103 and 104 without interfering with the flexible cable 100. The connector 109 has first and second connectors 106 and 107 formed on ends of the first and second cable portions 103 and 104, respectively, and the socket 120 has first and second sockets 121 and 123 attachable to or detachable from the first and second connectors 106 and 107, respectively.

Because the thermal printer having such a structure uses a single recording head in forming an image on both surfaces of a print medium, the thermal printer is compactly made. Additionally, because a flexible cable is disposed at one side or both sides of the print medium to connect the recording head to a main board, the connection structure between the recording head and the main board is compactly made, and the flexible cable does not interfere with the transfer of the print medium. Furthermore, since a portion of the flexible cable is attached to a rotating unit by a fixing holder, the space that the flexible cable occupies is reduced. Due to the miniaturization of the connection structure, the quality of an image data signal that is transmitted to the thermal printer is improved, and the emission of electronic waves is greatly reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A thermal printer, comprising:

a rotating unit rotatably installed within a frame and including a recording head to form an image on a print medium by heating a surface or an opposite surface of the print medium according to a location to which the recording head is rotated;

a support member installed opposite to the recording head to support the print medium;

a main board installed on the frame and supplying power and providing image data to the recording head; and a flexible cable disposed on one side or both sides of the print medium to connect the main board and the recording head, wherein the flexible cable is designed and disposed to not interfere with a transfer of the print medium and a reciprocating rotation of the recording head.

2. The thermal printer of claim 1, wherein a connector is formed on one end of the flexible cable; and a socket is installed on the main board and adapted to be coupled to the connector, such that the flexible cable is attachable to and detachable from the main board.

3. The thermal printer of claim 1, wherein the flexible cable includes a coupling portion coupled to the recording head; and a cable portion extending from at least one end of the coupling portion to connect the recording head to the main board, wherein the cable portion deforms or returns to the original shape according to a location to which the recording head is rotated.

4. The thermal printer of claim 3, wherein a connector is formed on one end of the flexible cable; and a socket is installed on the main board and adapted to be coupled to the connector such that the flexible cable is attachable to and detachable from the main board.

5. The thermal printer of claim 3, wherein the cable portion includes a first cable portion extending from one end of the coupling portion; and a second cable portion extending from the other end of the coupling portion, wherein a first width between the first and second cable portions is greater than a second width of the print medium.

6. The thermal printer of claim 5, wherein first and second connectors are formed on ends of the first and second cable portions, respectively; and first and second sockets are installed on the main board and into which the first and second connectors are inserted, respectively, such that the flexible cable is attachable to and detachable from the main board.

7. The thermal printer of claim 3, wherein a fixing holder is coupled to the rotating unit to fix the coupling portion onto the rotating unit.

8. The thermal printer of claim 7, wherein a connector is formed on one end of the flexible cable; and a socket is installed on the main board and adapted to be coupled to the connector, such that the flexible cable is attachable to and detachable from the main board.

9. A thermal printer, comprising:

a recording head rotatably installed within a frame to form an image on a print medium by heating a surface or an opposite surface of the print medium according to a location to which the recording head is rotated;

a platen roller installed opposite to the recording head to form a nip by supporting the print medium;

a support bracket to support the recording head so that the recording head rotates about a rotating shaft of the platen roller;

a driving source provides a rotating force to the support bracket;

a main board installed on the frame to supply power and provide image data to the recording head; and a flexible cable disposed on one side or both sides of the print medium to connect the main board to the recording head, such that the flexible cable is shaped and disposed to not interfere with a transfer of the print medium and a reciprocating rotation of the recording head.

10. The thermal printer of claim 9, wherein a connector is formed on one end of the flexible cable; and a socket is installed on the main board and adapted to be coupled to the connector, such that the flexible cable is attachable to and detachable from the main board.

11. The thermal printer of claim 9, wherein the flexible cable includes a coupling portion coupled to the recording head; and a cable portion extending from at least one end of the coupling portion to connect the recording head to the main board, wherein the cable portion deforms or returns to the original shape according to a location to which the recording head is rotated.

12. The thermal printer of claim 11, wherein a connector is formed on one end of the flexible cable; and a socket is installed on the main board and adapted to be coupled to the connector such that the flexible cable is attachable to and detachable from the main board.

13. The thermal printer of claim 11, wherein the cable portion includes a first cable portion extending from one end of the coupling portion; and a second cable portion extending from the other end of the coupling portion, wherein a first width between the first and second cable portions is greater than a second width of the print medium.

14. The thermal printer of claim 13, wherein first and second connectors are formed on ends of the first and second cable portions, respectively; and first and second sockets are installed on the main board and into which the first and second connectors are inserted, respectively, such that the flexible cable is attachable to and detachable from the main board.

15. The thermal printer of claim 11, wherein a fixing holder is coupled to the rotating unit to fix the coupling portion onto the rotating unit.

16. The thermal printer of claim 15, wherein a connector is formed on one end of the flexible cable; and a socket is installed on the main board and adapted to be coupled to the connector, such that the flexible cable is attachable to and detachable from the main board.

* * * * *